US005819357A

United States Patent [19]

Gould

[11] Patent Number: 5,819,357

[45] Date of Patent: Oct. 13, 1998

[54] STREET SWEEPER BRUSH ASSEMBLY

[76] Inventor: Frances Gould, R.R. D4-Box 100, Montague, N.J. 07827

[21] Appl. No.: 794,412

[22] Filed: Feb. 5, 1997

Related U.S. Application Data

[63] Continuation-in-part of Ser. No. 328,169, Oct. 25, 1994, abandoned.

[51] Int. Cl.[6] ..... A46B 1/00; A46B 3/16; A46B 7/00

[52] U.S. Cl. ..... 15/182; 15/179; 15/183; 15/193; 15/194; 15/202

[58] Field of Search ..... 15/179, 182, 183, 15/186, 191.1, 194, 195, 202

[56] References Cited

U.S. PATENT DOCUMENTS

| | | | |
|---|---|---|---|
| 2,045,270 | 6/1936 | Hoover | 15/183 |
| 2,261,781 | 11/1941 | Smellie | 15/183 |
| 2,578,549 | 12/1951 | Houban | 15/183 |
| 3,029,456 | 4/1962 | Pharo | 15/194 |
| 3,072,945 | 1/1963 | Peterson | 15/202 |
| 3,604,043 | 9/1971 | Lewis, Jr. | 15/183 |
| 3,771,189 | 11/1973 | Horton | 15/183 |
| 4,268,934 | 5/1981 | Testone | 15/202 |
| 4,856,925 | 8/1989 | Itonose | 15/191.1 |
| 4,988,146 | 1/1991 | Weihrauch | 15/191.1 |
| 5,078,158 | 1/1992 | Lemon | 15/183 |
| 5,588,172 | 12/1996 | Biocca | 15/179 |

FOREIGN PATENT DOCUMENTS

| | | | |
|---|---|---|---|
| 1251259 | 10/1971 | United Kingdom | 15/182 |

*Primary Examiner*—Randall E. Chin
*Attorney, Agent, or Firm*—Howard C. Miskin

[57] ABSTRACT

Brush bristle assemblies are formed into strips with strips of length of thermoplastic monofilaments which are mutually fused at their bottoms and formed into coupling bars with snaps fastening heads. The bars are slidably coupled to linear or helical channels or slots formed in rotary driven brush drum bristle substrates. In one form, the individual monofilament lengths are bent to form dart shaped loops. The bent thermoplastic lengths are longitudinally stacked with the apices of the contiguous loops being mutually fused to form a bristle strip. A hand brush is formed of a bunch of polypropylene filaments, the bottom section of which being mutually fused and shaped to form a bristle base and handle.

5 Claims, 4 Drawing Sheets

STREET SWEEPER BRUSH ASSEMBLY

This application is a continuation-in-part application under 37 CFR 1.62 of prior application Ser. No. 08/328,169 filed on Oct. 25, 1994 now abandoned.

BACKGROUND OF THE INVENTION

The present invention relates generally to improvements in brushes and it relates particularly to improved bristle replaceable brush assembles, especially strip type brush assemblies for mounting on cylindrical brush base drum street sweeper brooms.

In commercial and industrial brushes, for example street cleaning brushes employing rotary driver discs with cylindrical drums, the bristles are commonly formed of monofilament of thermoplastic material by reason of their flexibility and stiffness and their high abrasion resistance. The abrasion and wear of these bristles so used is high so that they must be frequently replaced. In the past, particularly in long lead helical brush strips mounted on the brush drum of street sweepers or axially extending straight brush strips, there have been considerable problems in assembling and especially in replacing the worn brush elements. The mounting and removal of the brush strips on a brush base drum was especially difficult if the base member or coupling bar of the strip was rigid, such as metal, and the brush receiving channel was helically positioned on the drum. Such a combination required preforming the brush strip to mate with the helix of the brush receiving channel. Further, the construction of the replaceable bristle assembly whether they were tufts or strips generally employed metallic or heterogeneous inserts in the brush substrate, and also materials such as glues or cements that formed part of or were attached to the bristle assemblies. When removed for replacement, these said materials were incompatible with the thermoplastic bristle material so that the recycling of the plastic material was extremely difficult or impossible by reason of the incompatibility of the metallic components or glue and cement with the thermoplastic material recycling procedure. Accordingly, the use of the conventional replaceable thermoplastic bristle assemblies was expensive, inefficient and otherwise left much to be desired. Furthermore, conventional brooms or brushes for industrial and household uses were not recyclable for the same reasons in that the bristles were generally permanently fixed into the substrate. After abrasion and wear, they had to be entirely discarded.

SUMMARY OF THE INVENTION

It is a principal object of the present invention to provide an improved brush.

Another object of the present invention is to provide an improved replaceable bristle brush.

Still another object of the present invention is to provide an improved brush replaceable integral bristle strip employing stiff, flexible bristles integrally extending from a coupling bar, all being of thermoplastic polymeric resin monofilament such as polypropylene or nylon.

Still a further object of the present invention is to provide an improved replaceable thermoplastic polymeric resin brush bristle strip without the backing of glue, cement or any other material incompatible with the recycling of the thermoplastic material to facilitate the recycling of the plastic material into fiber grade monofilaments.

The above and other objects of the present invention will become apparent from a reading of the following descriptions taken in conjunction with the accompanying drawings.

The present invention contemplates an improved brush replaceable thermoplastic polymeric resin bristle strip or assembly, in which the bottoms of the bristles are mutually fused and shaped into a strip type fastener. The bristle assembly may be in the shape of a bristle tuft or an elongated strip. When the bristle assembly is an elongated strip, the strip is advantageously formed of a plurality of contiguous generally parallelly aligned bristle members having one end integrally joined to and outwardly extending from a coupling bar or base member so that the other ends of the bristle members form a continuous brush surface. Advantageously, each bristle member in the strip is of a predetermined length of a thermoplastic monofilament, such as polypropylene or nylon, and having an inner end and an outer end. The coupling bar is formed preferably of the same thermoplastic material as the bristle members material and may be of different shapes to achieve the same result. One form of coupling bar is channel, i.e. generally "U" shaped, shaped with an open throat between a pair of arms extending from a base. The inner ends of the bristle members are received within the channel throat of the coupling bar and are integrally joined to the base with the outer ends of the bristle members extending from the base beyond the upper ends of the said coupling bar arms.

Another shape of the coupling bar is a wide base portion with a narrower central section extending up from the base portion. The bristles are integrally joined to and extend from the central section of the coupling bar. These various shaped coupling bars are discussed below. Advantageously, flanges extend outwardly and longitudinally from each side of the coupling bar. The inner ends of the bristle members and the corresponding mating surfaces of the coupling bar are integrally joined, to form a single entity creating a unitary, flexible, continuous longitudinal by extending brush strip, which can be easily fed into or removed from a mating channel mounted on a street sweeper drum or the like to form a brush. The flanges along the sides of the coupling bar hold the bristle strip in the channel on the drum and the flexibility of the bristle strips allow them to be readily mounted in or removed from corresponding helical or straight channels on and about the surface of a street sweeper drum without any preforming of the coupling bar.

Alternatively, the individual bristle member may also be folded at a mid-point to form a generally arrow-shaped head having a bottom head and upper lateral legs from each of which a bristle extends upwardly. A generally U shaped form may also be used. The bottoms of the stacked contiguous heads are mutually fused to form an integral strip assembly. Numerous constructions may be employed to replaceably anchor said strip assembly in corresponding channels in a brush base substrate without the use of metal glue or cement.

In another improved bristle assembly, in the form of a tuft, the bottoms of a tuft of bristles are mutually fused and molded into a snap fastener including flexible spaced arms extending outwardly from the bristle ends and terminating in barb-shaped ends which are snap acting, inwardly radially movable.

In the replaceable brush bristle assemblies of the present invention the assemblies are characterized by the absence of materials which are incompatible with the recycling of the replaced bristle assemblies and their subsequent processing into bristle suitable monofilaments.

DESCRIPTION OF THE PREFERRED EMBODIMENTS OF THE INVENTION

Figure 1:
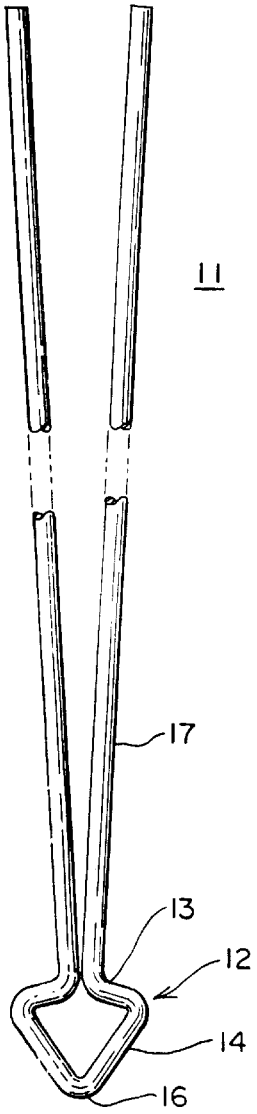
FIG. 1 is a front elevational view partially broken away, forming part of a bristle strip assembly in accordance with the present invention.
Figure 2:
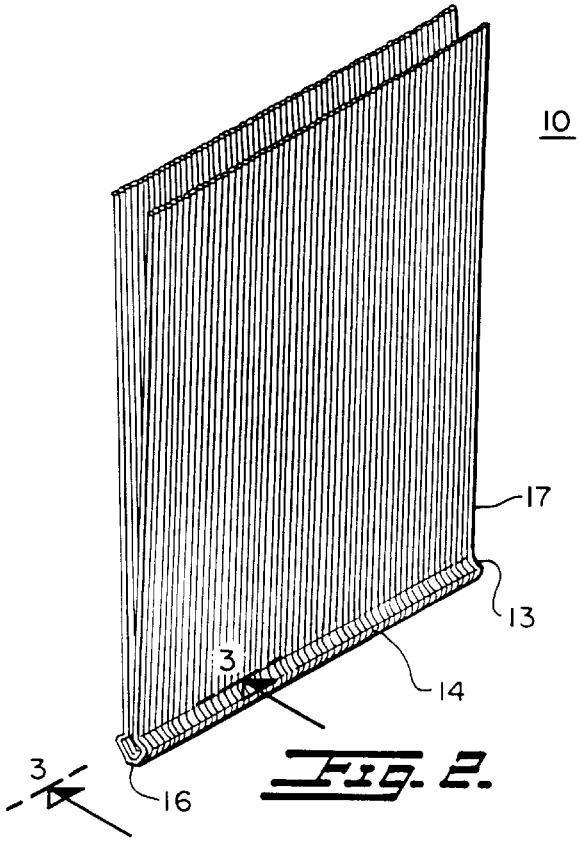
FIG. 2 is a front perspective view of a strip assembly from the bristle elements of FIG. 1.
Figure 3:
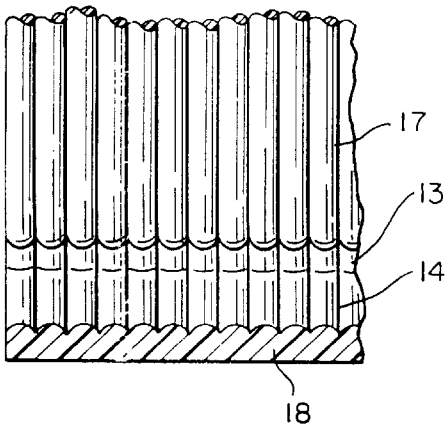
FIG. 3 is a partial, enlarged view taken along line 3—3 in FIG. 2.

Referring now to the drawings, particularly FIGS. 1 to 3 thereof, which illustrate an embodiment of the present invention, the reference numeral 10 generally designates a bristle assembly in the form of a strip of any desired length of longitudinally stacked bristle members 11. The bristle members 11 are each formed of a preset length of stiffly flexible, resilient thermoplastic polypropylene or nylon of bristle grade of a suitably chosen diameter. It is well known in the art as to how to produce such bristles.

Successive bristle members 11 are substantially coinciding and continuous in assembly 10.

Each bristle member 11 is integrally formed and bent from the polypropylene monofilament length to form a bottom male snap fastener coupling and defining an enlarged head 12 which includes oppositely located upper arms 13 each of which merges into a respective leg 14. Each of the legs 14 is inclined in a downwardly directed manner (as viewed in FIG. 1) and forms an apex 16 which may be rounded or flat. Projecting upwardly from the inner end of each aim 13 is an elongated bristle 17, the bristles 17 slightly upwardly diverging. The coupling head 12 is transversely resiliently compressible.

The successive bristle members 11 in strip assembly 10 are integrally formed by mutually fusing successive bridging apices 16 as seen at 18. The fusion may be effected in any known manner by raising the temperature of the stacked apices to at least the thermoplastic polymeric resin fusion temperature in any known manner such as for example, by applying an outside heat source or by laser beam or the like.

Figure 4:
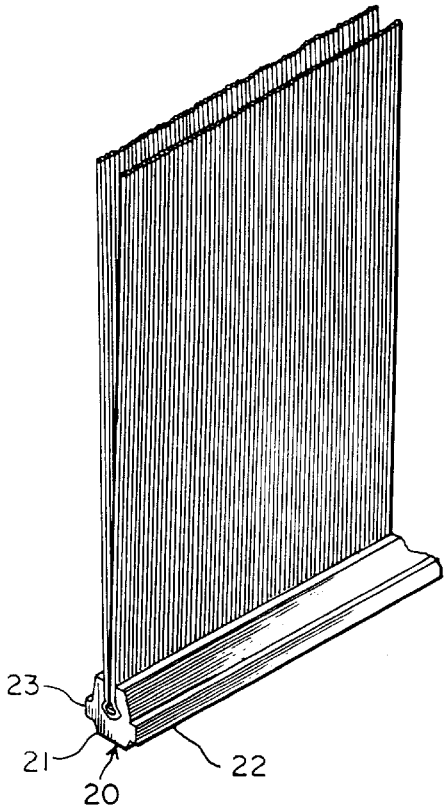
FIG. 4 is a perspective view illustrating the assembly of FIG. 2 replaceably connected to a coupling bar.
Figure 5:
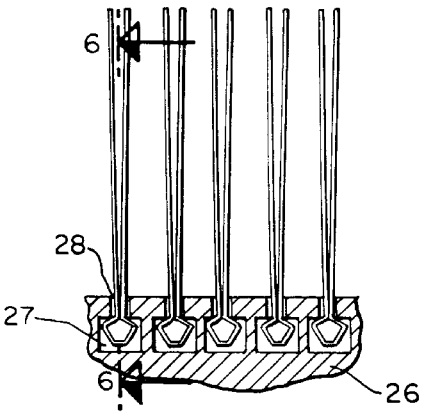
FIG. 5 is a partial transverse sectional view of the bristle strip of FIG. 2 replaceable to a brush substrate base.
Figure 6:
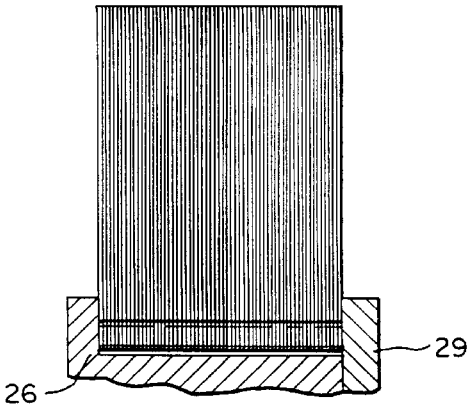
FIG. 6 is a sectional view taken along line 6—6 in FIG. 5.

As shown in FIG. 4, the bristle assembly may be removably mounted in a coupling bar or base member 20 which may be formed of a thermoplastic material such as nylon or polypropylene. Coupling bar 20 includes a body member 21 and having flanges 22 extending longitudinally along and outwardly from the sides of coupling bar 20 between the top and bottom thereof. An open topped channel 23 is formed in the top of and along the length of body member 21 and has a transverse cross-section approximately the shape of head 12. Channel 23 has a restricted throat along the top opening of channel 23.

A bristle assembly strip 10 may be coupled to bar 20 by pressing the fused bristle member heads 12 downwardly through the restricted throat of channel 23 to laterally compress coupling heads 12 by the pressure of the throat walls in arms 14 and upon the heads 12 reaching the bottom of channel 23 they expand to lock the bristle strip 10 to coupling bar 20. Alternately, a bristle strip 10 may be mounted to coupling bar 20 by sliding the fused heads of strip 10 through an open end and longitudinally along channel 23.

In FIGS. 5 to 8 there are shown the mounting of bristle strips 10 to different brush substrates. Thus, a planar brush substrate 26 has transversely spaced longitudinal channels 27, formed therein which have restricted throats 28. Each of the bristle strips 10 is coupled to a respective channel 27 by sliding the assembled heads 12 through a channel end opening along the length of the channel with the bristles 17 extending outwardly through throats 28. Alternatively, the heads 12 may be snapped inserted downwardly through throats 28. The channel end openings are releasably closed by removable end bar 29.

If desired a metal wire or strip, not shown, can be placed within the opening of head 12 of the bristle member 11 and then the head 12 and strip may be fused together. This construction provides a better lock in the channel throat.

Upon excessive wear of the bristles 17 of a bristle strip 10, the strip is removed from the substrate and recycled in the known manner.

Figure 7:
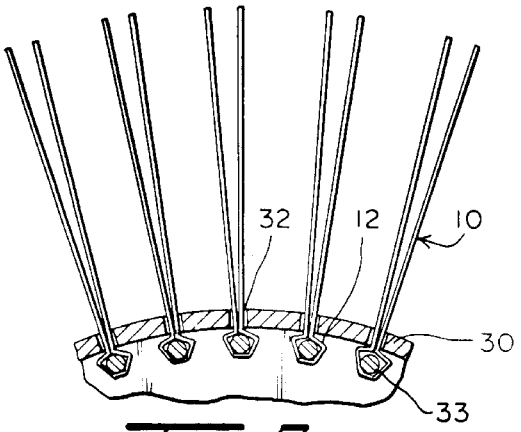
FIG. 7 is a partial transverse sectional view of the bristle strips of FIG. 2 replaceably anchored to a rotary brush drum substrate.
Figure 8:
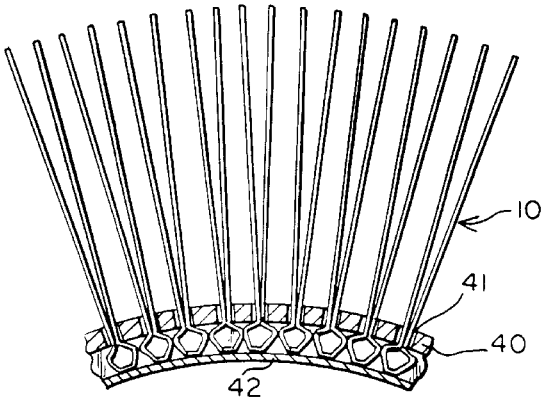
FIG. 8 is a view similar to FIG. 7 showing another method of anchoring the bristle strips to a brush drum.

In FIGS. 7 and 8, there are shown bristle strips 10 separably mounted to a motor driven brush drum 30 having peripherally spaced longitudinal slots 32. A strip 10 is slidably inserted in each slot 32 into the interior of the drum 30 or the coupling heads 12 of the strips 10 are snap inserted through the slots 32. The strips 10 are releasably locked in their drum mounted positions by inserting a removable locking bar 33 along the length of the aligned opening in the heads 12 of each of the bristle strips 10. An inner drum 42, as that shown in FIG. 8, may be provided with drum 30 and abutting the bottoms of bristle strip heads 12. Bars 33 releasably lock bristle strips 10 against withdrawal while the inner drum 42 prevents the radially inward movement of bristle strips 10. The inner drum 42 may be strips or supports to prevent inward movement of strips 10.

As seen in FIG. 8, the brush with motor driven drum 40 is similar to drum 30 and is similarly provided with peripherally spaced longitudinal slots 41 and the coaxial inner drum 42. The fused strip coupling heads 12 of strip 10 are entrapped between inner and outer drums 42 and 40, respectively, to prevent the inner radial movement of bristle strips 10.

Figure 9:
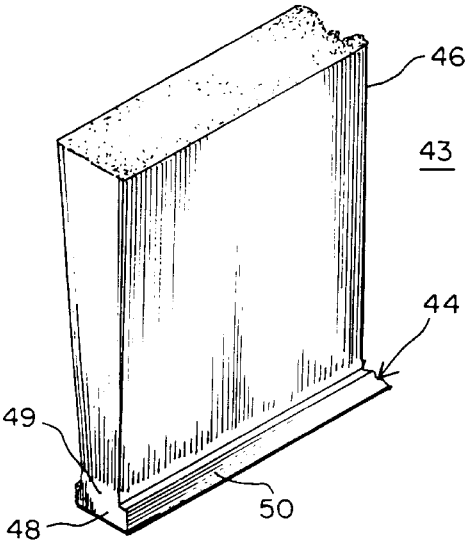
FIG. 9 is a perspective view of another form of bristle strip in accordance with the present invention.
Figure 10:
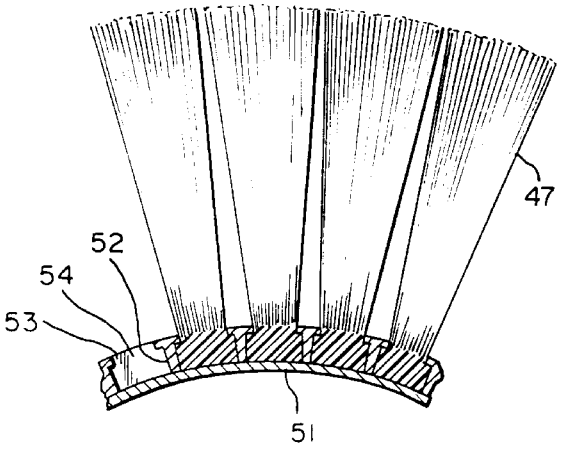
FIG. 10 is a partial transverse sectional view of a rotating drum brush employing the bristle strip of FIG. 9.

Referring to FIGS. 9 and 10 of the drawings, which illustrate another bristle strip 43 embodying the present invention, in which a longitudinally extending coupling bar or base member 44 is integrally formed with a corresponding longitudinally extending bristle assembly 46 of groups of side-by-side contiguous bristles 47 members which diverge upwardly from coupling bar 44. Bristles 47 and coupling bar 44 are formed of a thermoplastic polymer, preferably polypropylene. As shown, coupling bar 44 includes a wide lower section or base 48 and a narrower upper section 49 delineated by a pair of coplanar shoulders or flanges 50 extending longitudinally from opposite sides of coupling bar 44. The bristle strip 43 may be formed by assembling bristle assemblies 46 in a tight longitudinal assembly of contiguous side-by-side bristle members 47, each having an upper end and a lower end heating the lower ends of this assembled bristle members, to their fusion temperature and their moldable flow temperature and then pressing the heated lower ends of the bristles in a multisection mold having a cavity complementing the coupling bar 44.

The bristle strips 43 are replaceably mounted on a motor driven brush drum 51 having on its outer face peripherally spaced longitudinally extending T-shaped bars 52 which delineated side-by-side longitudinal channels 53 having restricted throats 54. The coupling bar 44 of each bristle strip 46 is matingly longitudinally inserted in a respective channel with bristles 47 extending outwardly through throats 54. The strips may be removed by longitudinally sliding them from channels 53. Channels 53 cooperatively mate with the outer configuration of the coupling bar being used, whether as shown in FIGS. 9 and 10 or shown in FIG. 4.

Figure 14:
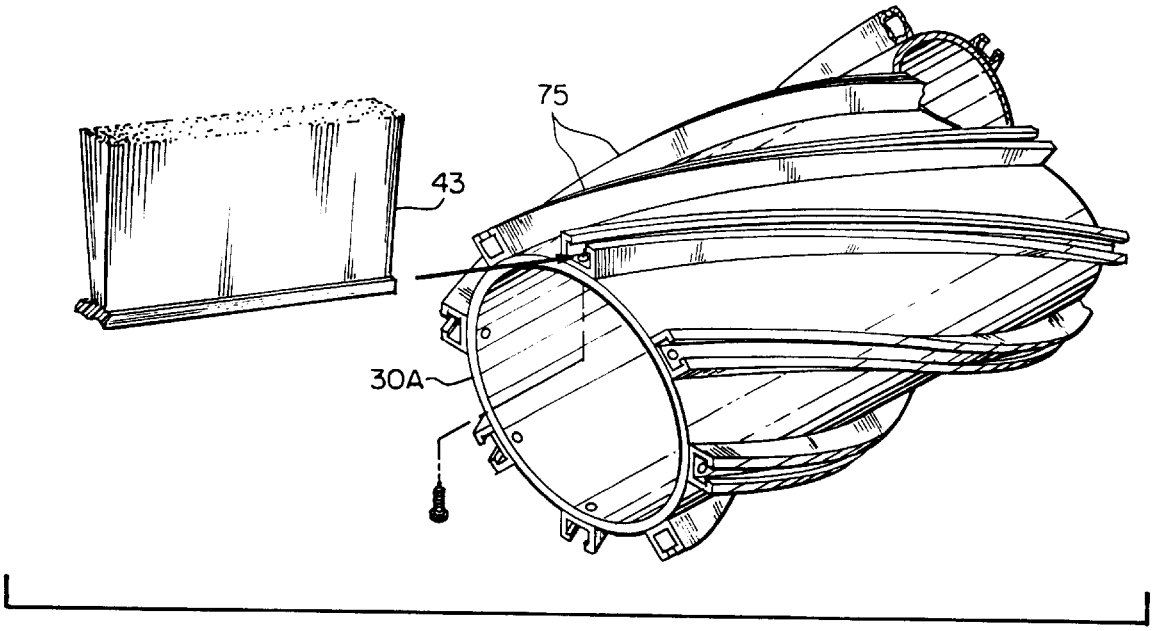
FIG. 14 is an isometric view of a base drum having helical surface channels to receive a brush strip assembly.
Figure 15:
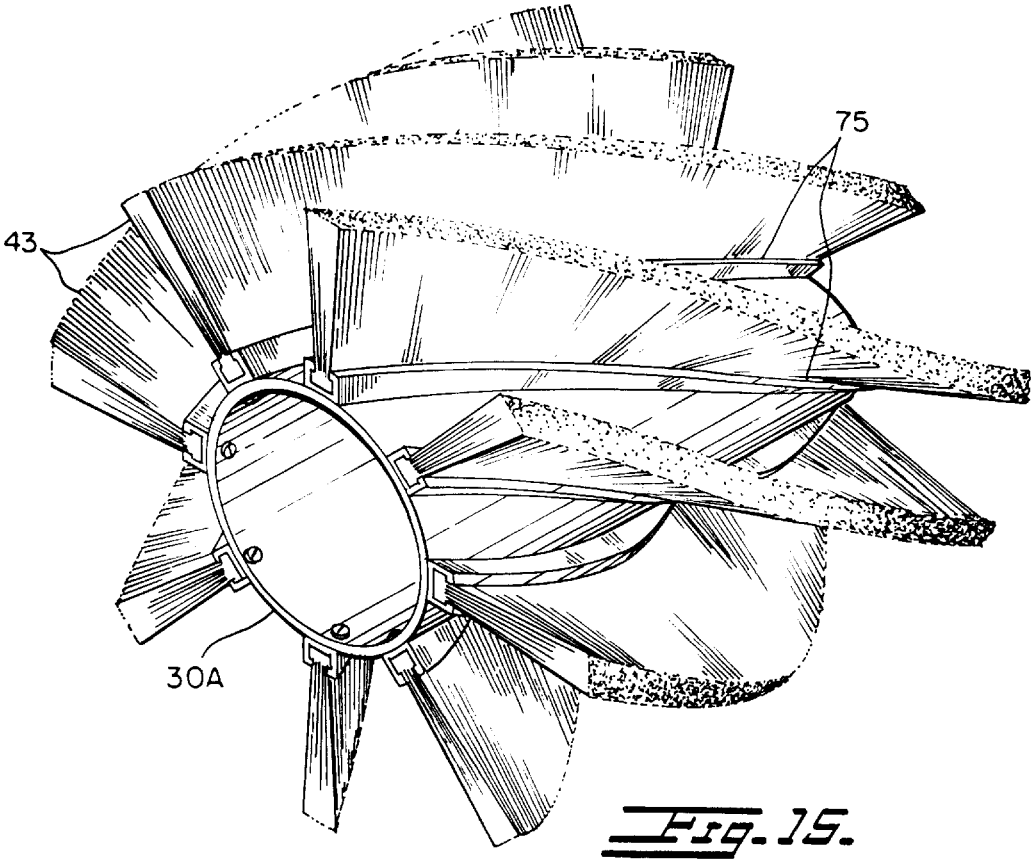
FIG. 15 is an isometric view of bristle strips of the types illustrated in FIG. 9 and 10 mounted helically on a drum.

Bristle strips 43 are mounted onto brush drum 51 30*a* (to be described with reference to FIG. 14) via coupling bar 44 or any other suitable substrate that is capable of being disposed matingly and longitudinally with a base drum 51. The peripheral arrangement of the channels to receive strip 43 on drum 30*a* may be of a longitudinal helical curvature (see FIG. 14). The helical curvature at which bristle strips may be arranged in the brush base drum as illustrated in FIG. 14 and 15 is possible when the plastic bristle strips have been heat fused to form an integral unitary brush strip, and mounted in a channel bar. Unlike the use of a metal substrate which must be preformed to allow for curvature, the thermoplastically fused bristle strips permit curvature without preformation.

Figure 11:
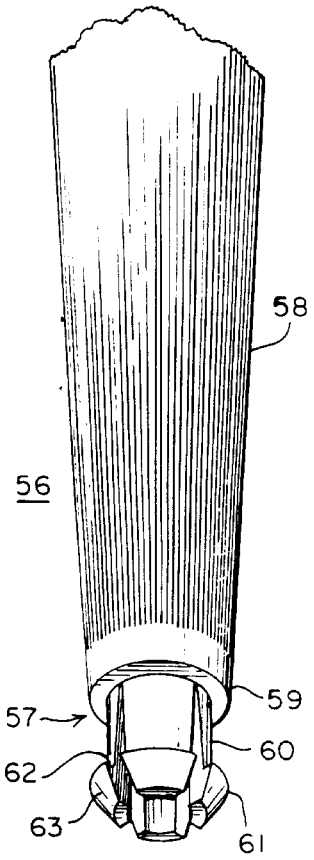
FIG. 11 is a front perspective view of a snap-on bristle tuft in accordance with the present invention.
Figure 12:
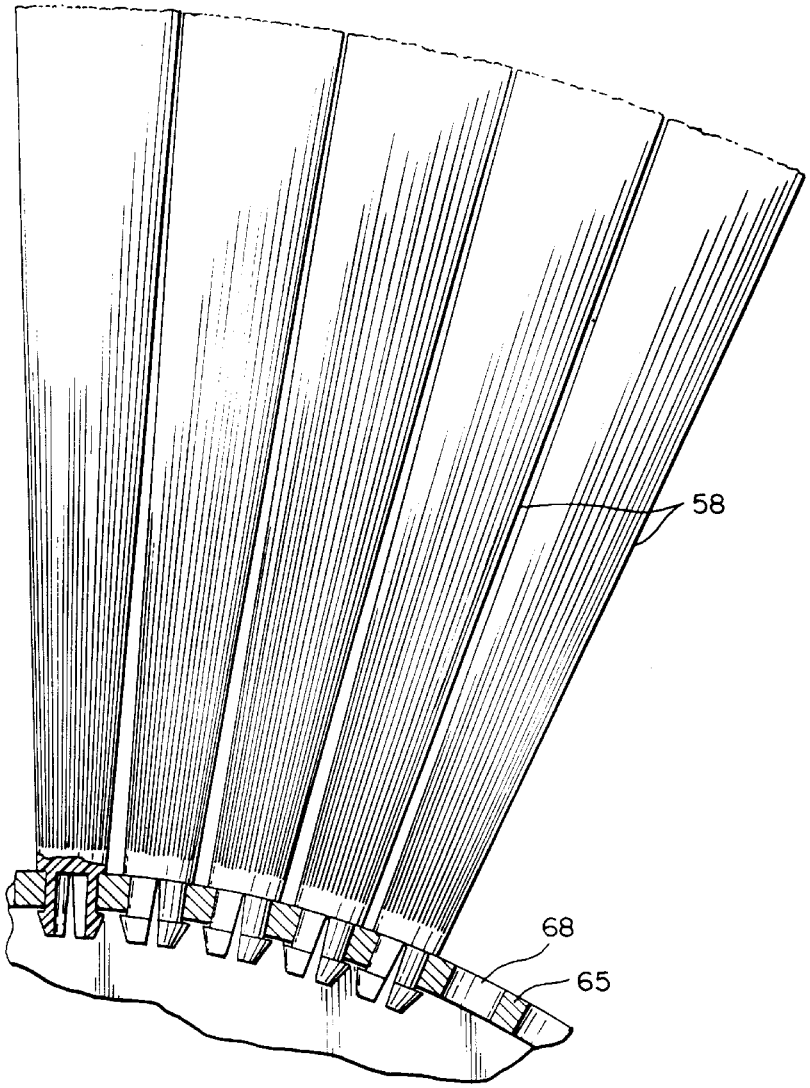
FIG. 12 is a partial transverse sectional view of a brush drum employing the bristle tufts of FIG. 11.

A snap-on bristle assembly 56 in the form of a bristle tuft embodying the present invention is shown in FIGS. 11 and 12 and includes a group of gathered upwardly, diverging polypropylene bristles 58 joined at their bases by a coupling section 57 integrally formed by fusing and molding the lower parts of lengths of bunched plastic monofilaments whose upper portions define bristles 58. Coupling section 57 includes an upper cylindrical base portion 59 from which bristles 58 extend and formed by the fusion of the bottoms of bristles 58. Extending from base section 59 are a plurality of peripherally spaced resilient fingers 60, the outer and inner faces of which are coaxial with base portion 59. Fingers 60 normally downwardly diverge and each terminates in a dart section 61, each of which includes a concealed outer face 63 and a flat accurate top shoulder 62. Fingers 60 are radially and inwardly offset from the bottom peripheral edge of base portion 59.

The bristle assemblies 56 may be mounted to a brush drum 65 having longitudinally and peripherally spaced circular holes 68 by inserting in each of the holes 68 a bristle assembly coupling section 57. Upon pressing downwardly on coupling section 57, the upper edge of a respective hole 68 bears on outerface 63 to radially compress fingers 60 and darts 61 to permit their passage into the hole 68. Upon full insertion of the coupling section, the bottom face of base portion 59 rests. The outer face 63 and dart section 61 of each of the fingers 60 pass through a respective hole 68 permitting the resilient expansion of fingers 60 with its shoulders engaging the inside face of drum 65 so as to lock the bristle tuft assembly 56 to the drum to lock the bristle tuft assembly to the drum.

Figure 13:
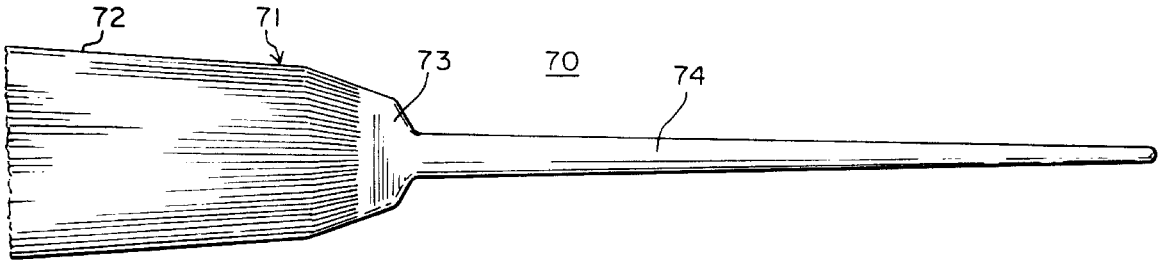
FIG. 13 is a side elevational view of a hand brush embodying the present invention.

A hand brush 70, as illustrated in FIG. 13, is constructed in accordance with the present invention and includes a brush head 71 of polypropylene bristles 72 mutually fused at their bottoms to form a bristle base 73 and an elongated handle 74 extending from base 73. In protruding brush 70, a bunched group of lengths of plastic monofilaments of brush bristle grade is assembled. An end section of the bunched group is heated to the flow temperature of the plastic and is molded into a suitable shape and then cooled.

A helical arrangement of the bristle strips 43 in channel bars 75 mounted on drum 30*a* is shown in FIGS. 14 and 15. The construction of the bristle strips, especially as described in FIGS. 9, 10, 14 and 15, allows their easy assembly and replacement on the street sweeper, whenever necessary. While polypropylene has been disclosed as the preferred thermoplastic material used in the various embodiments, other plastics, including copolymers, may be so used.

While there have been described and illustrated preferred embodiments of the present invention, it is apparent that numerous omissions and additions may be made without departing from the spirit thereof.

I claim:

1. A street sweeper brush assembly comprising a bristle strip having a plurality of contiguous generally parallelly aligned bristle members that are longitudinally stacked side-by-side to form a continuous bristle assembly, each bristle member being formed of a thermoplastic monofilament having an inner end and an outer end, a coupling bar having an upper section and an outwardly and longitudinally extending shoulder along each side, said inner ends of said bristle members of said bristle assembly being integrally joined with said upper section of said coupling bar with said outer ends of said bristle members forming a continuous unitary brush surface longitudinally extending along said coupling bar, and a cylindrical street sweeper brush base drum having a longitudinal axis of rotation and having peripherally spaced and longitudinally extending channels, each channel having a base with spaced apart arms extending therefrom, said channel arms having spaced apart facing flanges, each flange having a lower surface facing said base of the channel, said continuous longitudinal coupling bar slidably disposed in said channel with the bristle outer ends extending between and beyond said channel flanges, said coupling bar shoulders cooperatively mating with corresponding lower surfaces of said channel flanges, whereby said strip of bristle members are secured to the brush base drum, said channels being helically arranged along said brush base drum, said helically arranged channels being of a curvature of up to 45 degrees relative to the longitudinal axis of said base drum.

2. A street sweeper brush assembly comprising a bristle strip having a plurality of contiguous generally parallelly aligned bristle members that are longitudinally stacked side-by-side to form a continuous bristle assembly, each bristle member being formed of a thermoplastic monofilament having an inner end and an outer end, a coupling bar having an outwardly and longitudinally extending shoulder along each side, said inner ends of said bristle members of said bristle assembly being integrally joined with an upper section of said coupling bar with said outer ends of said bristle members forming a continuous unitary brush surface longitudinally extending along said coupling bar and a cylindrical base drum having peripherally spaced longitudinal channels about said base drum, said longitudinally extending channels having an outer face, said continuous longitudinal coupling bar with said rows of bristles, having an enlarged head, each of said longitudinal channels having a restricted throat along its inner face, said enlarged head of said continuous longitudinal coupling bar slidably engaging a corresponding channel with the respective bristle outer ends on said coupling bar projecting outwardly through the respective channel throat.

3. A flexible bristle strip adapted to be removeably mounted on a cylindrical street sweeper brush base drum rotating about an axis, comprising an elongated bristle assembly of a plurality of contiguous generally parallelly aligned bristle members, each bristle member being formed of a thermoplastic monofilament having an inner end and a spaced apart outer end, and an elongated thermoplastic coupling bar integrally formed with the inner ends of said bristle members and having shoulders longitudinally extending along opposite sides, said outer ends of said bristle members forming a continuous brush surface, whereby the integrally formed bristle inner ends and said coupling bar provide an integral unitary strip of continuous bristles, said brush base drum having peripherally spaced restricted throat channels mounted along said base drum outer surface, said channels being generally U-shaped having flanges extending inwardly from each arm of said U-shaped channel and spaced apart to form said restricted throat opening along said channel, said shoulders of said coupling bar mating with corresponding lower surfaces of said flanges of said channel, said bristle outer ends of said bristle strip projecting outwardly through said throat opening of said channel.

4. A street sweeper broom assembly comprising a bristle strip having a plurality of contiguous generally parallelly aligned bristle members that are longitudinally stacked side-by-side to form a continuous bristle assembly, each bristle member being formed of a thermoplastic monofilament having an inner end and an outer end, a coupling bar having an outwardly and longitudinally extending shoulder along each side, said inner ends of said bristle members of said bristle assembly being integrally joined with an upper section of said coupling bar with said outer ends of said bristle members forming a continuous unitary bristle assembly longitudinally extending along said coupling bar, and a cylindrical street sweeper brush base drum having a longitudinal axis of rotation and having peripherally spaced and longitudinally extending channels, each channel having a base with spaced apart arms extending therefrom, a flange extending from each of said channel arms, each flange having a lower surface overlaying and facing the base of said channel and an end facing and spaced apart from each other, said continuous longitudinal coupling bar slidably disposed in said channel with the bristle outer ends extending between and beyond said channel flanges said coupling bar shoulders cooperatively mating with corresponding lower surfaces of said channel flanges, whereby said strip of bristle members are secured to the brush base drum.

5. A street sweeper broom assembly comprising a bristle strip having a plurality of contiguous generally parallelly aligned bristle members that are longitudinally stacked side-by-side to form a continuous bristle assembly, each bristle member being formed of a thermoplastic monofilament having an inner end and an outer end, a coupling bar having an outwardly and longitudinally extending shoulder along each side, said inner ends of said bristle members of said bristle assembly being integrally joined with an upper section of said coupling bar with said outer ends of said bristle members forming a continuous unitary bristle assembly longitudinally extending along said coupling bar, and a cylindrical street sweeper brush base drum having a longitudinal axis of rotation and having peripherally spaced and longitudinally extending channels, each channel having a base with spaced apart arms extending therefrom, a flange extending from each of said channel arms, each flange having a lower surface overlaying and facing the base of said channel and an end facing and spaced apart from each other, said continuous longitudinal coupling bar slidably disposed in said channel with the bristle outer ends extending between and beyond said channel flanges, said coupling bar shoulders cooperatively mating with corresponding lower surfaces of said channel flanges, whereby said strip of bristle members are secured to the brush base drum, said channels being helically arranged along said brush base drum.

* * * * *